US007940290B2

(12) United States Patent
Nureki et al.

(10) Patent No.: US 7,940,290 B2
(45) Date of Patent: May 10, 2011

(54) THERMAL PRINTER

(75) Inventors: Shinji Nureki, Chiba (JP); Kazuhisa Onishi, Torrance, CA (US)

(73) Assignee: Seiko Instruments Inc. (JP)

( * ) Notice: Subject to any disclaimer, the term of this patent is extended or adjusted under 35 U.S.C. 154(b) by 20 days.

(21) Appl. No.: 12/454,573

(22) Filed: May 19, 2009

(65) Prior Publication Data

US 2009/0290010 A1 Nov. 26, 2009

(30) Foreign Application Priority Data

May 21, 2008 (JP) ..... 2008-133140

(51) Int. Cl.
*B41J 11/04* (2006.01)
*B41J 11/36* (2006.01)
*B41J 11/42* (2006.01)

(52) U.S. Cl. ..... 347/218

(58) Field of Classification Search ..... 347/171, 347/215, 218; 400/578
See application file for complete search history.

(56) References Cited

U.S. PATENT DOCUMENTS 6,249,302 B1 * 6/2001 Sekiya ..... 347/220
7,164,508 B2 * 1/2007 Fujinawa et al. ..... 358/474
* cited by examiner

*Primary Examiner* — Huan H Tran
(74) *Attorney, Agent, or Firm* — Adams & Wilks

(57) ABSTRACT

A thermal printer includes a main body frame, a thermal head swingably attached to the main body frame, a platen roller disposed to face a printing surface of the thermal head, and a motor for rotationally driving the platen roller. The thermal printer activates the thermal head while conveying a heat-sensitive paper held between the thermal head and the platen roller to perform printing on the heat-sensitive paper. The feeding amount of the heat-sensitive paper may be set so that an aspect ratio of the characters printed on the heat-sensitive paper is within a range of 0.95:1 to 0.8:1.

10 Claims, 12 Drawing Sheets

FIG. 2

| NUMBER | 1 | 2 | 3 | 4 | 5 | 6 | 7 | 8 | 9 | 10 | 11 | 12 | 13 |
|---|---|---|---|---|---|---|---|---|---|---|---|---|---|
| ASPECT RATIO (PRINTING HEIGHT) | 1 | 0.95 | 0.9 | 0.85 | 0.8 | 0.75 | 0.7 | 0.65 | 0.6 | 0.55 | 0.5 | 0.45 | 0.4 |
| RATIO (%) OF THOSE WHO HAVE NOT FELT UNCOMFORTABLE | 100.0 | 95.6 | 87.6 | 75.2 | 59.3 | 45.1 | 22.1 | 13.3 | 6.2 | 2.7 | 1.8 | 0.9 | 0.0 |

THERMAL PRINTER

BACKGROUND OF THE INVENTION

1. Field of the Invention

The present invention relates to a thermal printer.

2. Description of the Related Art

Conventionally, as a thermal printer, for example, one disclosed in JP 2000-318260 A has been known.

In the thermal printer described in JP 2000-318260 A, an aspect ratio of characters printed on heat-sensitive paper during passage between a thermal head and a platen roller is set to 1:1, and the printed heat-sensitive paper is provided to a user.

However, in view of ecology and environmental performance, there is a strong demand for a thermal printer in which a use amount of heat-sensitive paper is reduced (or may be reduced) from a user.

SUMMARY OF THE INVENTION

The present invention has been devised with the above situation in mind, and it is an object of the present invention to provide a thermal printer in which characters printed on heat-sensitive paper may be received by a user without any uncomfortable feelings when the heat-sensitive paper is provided to the user, and a use amount of the heat-sensitive paper may be reduced.

In order to achieve the object, the present invention employs the following means.

According to an aspect of the present invention, there is provided a thermal printer, including: a main body frame; a thermal head attached to the main body frame to swing; a platen roller disposed to face a printing surface of the thermal head; and a motor for rotating and driving the platen roller, the thermal printer being configured to activate the thermal head while conveying heat-sensitive paper held between the thermal head and the platen roller to perform printing on the heat-sensitive paper, in which a feeding amount of the heat-sensitive paper may be set so that an aspect ratio of characters printed on the heat-sensitive paper is within a range of 0.95:1 to 0.8:1.

According to the thermal printer of the present invention, a printing length (printing height) of a conveying direction is shortened (compressed) by 5% to 20%. Thus, a use amount of heat-sensitive paper may be reduced by 5% to 20%, enabling reduction of running costs.

Shortening of the printing length of the conveying direction by 5% to 20% enables reduction of a changing frequency of heat-sensitive paper, thereby reducing time and labor for changing work. The spared time and labor may be used for services to customers.

Further, distribution expenses from a heat-sensitive paper maker to end users may be reduced by 5% to 20%.

Further, a use amount of heat-sensitive paper and a distribution amount from the heat-sensitive paper maker to the end users may be lowered, enabling reduction of a $CO_2$ emission amount by 5% to 20%.

It is more preferred that the thermal printer described above further include a rotation transmission mechanism for transmitting a rotation force of the motor to the platen roller, in which by changing at least one gear constituting the rotation transmission mechanism for another, the feeding amount of the heat-sensitive paper may be set.

According to the thermal printer as described above, at least one gear constituting the rotation transmission mechanism may be easily changed for another gear of a different gear ratio. In other words, changing at least one gear constituting the rotation transmission mechanism for another gear of a different gear ratio enables changing of a feeding amount of the heat-sensitive paper passed between a printing surface of the thermal head and the platen roller, thereby changing the aspect ratio of the characters printed on the heat-sensitive paper from, for example, 1:1 to 0.9:1 or 0.8:1. Changing another gear of a different gear ratio for a regular gear enables changing of the aspect ratio of the characters printed on the heat-sensitive paper from, for example, 0.8:1 or 0.9:1 to 1:1.

Thus, the user of the thermal printer can easily change the aspect ratio of the characters printed on the heat-sensitive paper only by changing at least one gear constituting the rotation transmission mechanism for another. As a result, convenience may be improved for the user.

The maker that manufactures and sells the thermal printer can easily change the aspect ratio of the characters printed on the heat-sensitive paper to meet needs of the user of the thermal printer. Thus, differentiation from products of other companies may be achieved.

It is more preferred that, in the thermal printer described above, by changing the platen roller for another, the feeding amount of the heat-sensitive paper may be set.

According to the thermal printer, the feeding amount of the heat-sensitive paper passed between the printing surface of the thermal head and the platen roller is changed by replacing the platen roller with another platen roller of a different outer diameter, thereby enabling changing of the aspect ratio of the characters printed on the heat-sensitive paper from, for example, 1:1 to 0.9:1 or 0.8:1. Replacing a platen roller of a small outer diameter with a regular platen roller enables changing of the aspect ratio of characters printed on the heat-sensitive paper from, for example, 0.8:1 or 0.9:1 to 1:1.

Thus, the user of the thermal printer can easily change the aspect ratio of the characters printed on the heat-sensitive paper only by replacing the platen roller with another. As a result, convenience may be improved for the user.

The maker that manufactures and sells the thermal printer can easily change the aspect ratio of the characters printed on the heat-sensitive paper to meet needs of the user of the thermal printer. Thus, differentiation from products of other companies may be achieved.

Further, the thermal printer according to the aspect of the present invention may further include an urging force correction means for changing, by changing an urging force for urging the thermal head toward the platen roller, a press-contact force of the thermal head to the platen roller.

Thus, even when a platen roller of a small outer diameter is attached (loaded), an original state may be maintained without reducing a press-contact force of the thermal head to the platen roller.

Further, the thermal printer according to the aspect of the present invention may further include: a lock arm for rotatably supporting bearings disposed in both ends of the platen roller; and a spring for generating an urging force in a direction pressing the thermal head to the platen roller supported by the lock arm, in which the urging force correction means may change outer diameters of the bearings supported by the lock arm.

Further, the thermal printer according to the aspect of the present invention may further include: an auxiliary plate disposed between the main body frame and the thermal head to move; and a spring disposed between the auxiliary plate and the thermal head to generate an urging force in a direction pressing the thermal head to the platen roller, in which the urging force correction means may include an adjusting member for adjusting an elastic deformation amount of the spring via the auxiliary plate.

Further, the thermal printer according to the aspect of the present invention may further include a head support for supporting the thermal head, in which the urging force correction means may be structured so that one of a plurality of projections and a plurality of concaves are disposed in opposing positions of the main body frame and the head support, and a platen-direction pressing force of the thermal head is changed by changing the number of coil springs disposed in positions of the one of the plurality of projections and the plurality of concaves.

Further, the thermal printer according to the aspect of the present invention may further include: a head support for supporting the thermal head; and a spring for generating an urging force in a direction pressing the thermal head to the platen roller, in which the urging force correction means may be structured so that a platen-direction pressing force of the thermal head is changed by changing a position of the spring to a different position of a facing distance between the main body frame and the head support based on a step disposed in at least one of the main body frame and the head support.

Further, in the thermal printer according to the aspect of the present invention, the rotation transmission mechanism may include a casing having a groove for detachably moving the gear, and a cover for covering a shaft of the gear with an end of the groove of the casing.

Further, in the thermal printer according to the aspect of the present invention, the rotation transmission mechanism may change the gear by attaching/detaching an opening/closing member disposed in a shaft end of the gear.

Further, in the thermal printer according to the aspect of the present invention, the rotation transmission mechanism may change the gear by removing a detachable spacer disposed in a shaft end of the gear.

The thermal printer according to the present invention is advantageous in that when the heat-sensitive paper is provided to the user, the characters printed on the heat-sensitive paper may be received by the user without any uncomfortable feelings, and a use amount of the heat-sensitive paper may be reduced.

BRIEF DESCRIPTION OF THE DRAWINGS

In the accompanying drawings:

FIG. 2 is a table illustrating the number of replies for each print example used for questionnaire survey by "ratio (%) of those who have not felt uncomfortable";

FIG. 6A is a schematic configuration diagram of a rotation transmission mechanism, and FIG. 6B is a perspective diagram of a cover constituting the rotation transmission mechanism;

FIG. 7A is a sectional diagram of a rotation transmission mechanism, and FIG. 7B is a schematic configuration diagram illustrating a cover removed state;

FIG. 13A is a main-portion back diagram, and FIG. 13B is a sectional diagram of FIG. 13A;

DETAILED DESCRIPTION OF THE PREFERRED EMBODIMENTS

Figure 1:
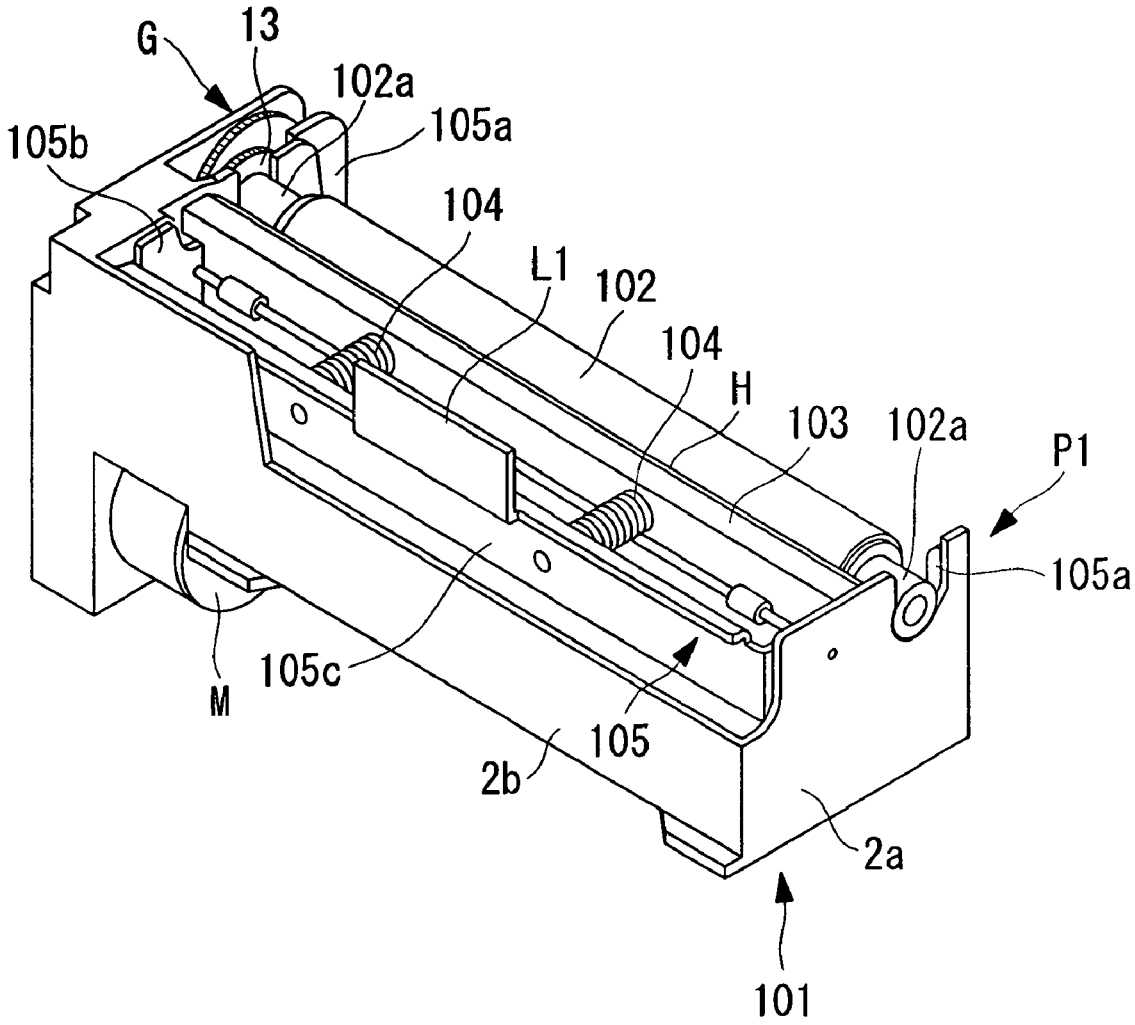
FIG. 1 is a perspective diagram illustrating a thermal printer according to a first embodiment of the present invention.

Referring to FIG. 1, a thermal printer according to a first embodiment of the present invention is described below. FIG. 1 is a perspective diagram illustrating the thermal printer of this embodiment.

A thermal printer P1 mainly prints item names and price information with horizontal writing and the fixed number of printing digits, and is mounted on an information terminal (not shown) varied in output length depending on the number of items. As illustrated in FIG. 1, the thermal printer P1 includes a platen roller 102 rotatably supported on a main body frame 101, a head support 103 equipped with a thermal head H facing the platen roller 102, two coil springs 104 for applying urging forces to press the head support 103 to the platen roller 102, a lock arm 105 for rotatably supporting bearings 102*a* disposed in both ends of the platen roller 102, a motor (stepping motor) M as a driving source, and a rotation transmission mechanism (gear transmission mechanism) G for transmitting a rotation driving force of the motor M to a driven gear 13 fixed to one end of the platen roller 102.

The lock arm 105 includes a pair of hook-shaped bearing supports (latch units) 105*a* engaged with the bearings 102*a* of the platen roller 102 to draw a surface of the platen roller 102 so as to press it into contact with the thermal head H side, a pair of arms 105*b* for guiding the bearing supports 105*a* to the rear of the head support 103 via both sides of the head support 103, and an elastic member support 105*c* equipped with the arms 105*b* in both ends thereof and disposed in a width direction of the rear of the head support 103, for supporting the coil springs 104.

The lock arm 105 is rotatably supported on both side surfaces 2*a* of the main body frame 101.

On an upper end of the elastic member support 105*c* of the lock arm 105, a release lever L1 is disposed as a disengaging means for swinging the lock arm 105 itself to the side of the platen roller 102 so as to disengage the bearing supports 105*a* and the bearings 102*a* of the platen roller 102 from each other.

In the thermal printer P1 of this embodiment, a feeding amount (more specifically, an outer diameter of the platen roller 102 or a gear ratio of a gear constituting the rotation transmission mechanism G) of heat-sensitive paper is set so that an aspect ratio of characters printed on the heat-sensitive paper passed between a printing surface (not shown) of the thermal head H and the platen roller 102 may be a value (e.g., 0.8:1) within a range of 0.95:1 to 0.8:1.

According to the thermal printer P1 of this embodiment, a printing length (printing height) of a conveying direction is shortened (compressed) by 5% to 20%, enabling reduction of a use amount of the heat-sensitive paper by 5% to 20%. Thus, running costs may be reduced.

Shortening the printing length of a conveying direction by 5% to 20% enables reduction of a changing frequency of heat-sensitive paper, thereby reducing time and labor necessary for changing work. The time and labor thus spared may be used for services to customers.

Distribution expenses from a heat-sensitive paper maker to an end user may be reduced by 5% to 20%.

Further, a use amount of heat-sensitive paper and a distribution amount from the heat-sensitive paper maker to the end user may be reduced, thereby reducing $CO_2$ emission amount by 5% to 20%.

A reason for setting the aspect ratio of characters printed on the heat-sensitive paper to the range of 0.95:1 to 0.8:1 is described.

First, the reason is based on a result of studies that vertical and horizontal lines are seen equal in length when an aspect ratio of 0.86:1 is set because a geometrical illusion (human eye illusion:Wundt Fick illusion) causes the vertical line to look longer than the horizontal line. Especially, when a character string printed on curved paper such as roll paper as in the case of a receipt is seen, due to inaccurate human visual length measurement, Müller-Lyer illusion occurs in which there is an illusion amount of about 5 mm with respect to a length of 100 mm. By combining these, an aspect ratio of no uncomfortable feelings may be set to about 0.8:1.

Second, the reason is based on characteristics of the thermal printer.

At present, a head of the thermal printer has a dot pattern of 8 dots/mm. Thus, a size per dot is 125 μm. To prevent generation of white lines between dots adjacent to each other in a feeding direction, an actual size of the thermal head is about 145 μm in which it is slightly longer in the feeding direction. In printing of a font having a part away by only 1 dot in the feeding direction, a feeding amount has to be set to about 100 μm considering that a size limit enabling visual recognition of 1-dot separation is about 40 to 50 μm, and an aspect ratio is about 0.8:1.

Third, the reason is based on a result of studies that a recognition limit enabling differentiation of "O" (alphabet), "0" (numeral) and "○" (circle) of a font is an aspect ratio set to about 0.8:1.

In the case of the thermal printer which mainly prints item names and price information as a receipt, since printing is horizontal writing, and its contents are mainly item names and price information, the number of printing digits is fixed, and an output length varies depending on the number of items. Roll paper realizing different lengths with a fixed paper width is accordingly used. Thus, it is advantageous to set an aspect ratio within a range of 0.95:1 to 0.8:1 so as to prevent occurrence of uncomfortable feelings or inconveniences caused by the above-mentioned illusion or the characteristics of the thermal printer.

The following questionnaire survey was conducted so as to further clarify the reason.

The questionnaire survey was conducted on how much a printing length of a conveying direction was permitted to be shortened (compressed) without giving any uncomfortable feelings by asking 113 males and females of 20s to 50s to see 13 types of printed sentence examples including Chinese characters, alphanumeric characters, Hiragana characters; and symbols and having printing aspect ratios different from one another by 5% without any comparison with other print examples.

Figure 3:
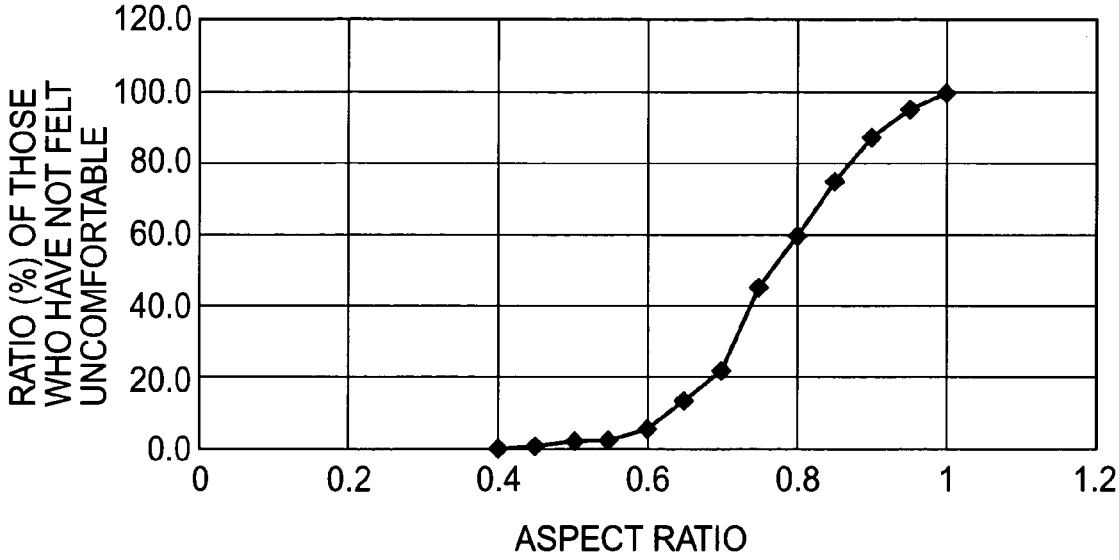
FIG. 3 is a broken-line graph illustrating results of FIG. 2 in an easily understandable manner.

FIG. 2 is a table illustrating "ratio (%) of those who have not felt uncomfortable" for each print example, and FIG. 3 is a broken-line graph illustrating results of FIG. 2 in an easily understandable manner.

As may be understood from the questionnaire results of FIGS. 2 and 3, most (about 60%) replied with no uncomfortable feelings even when the printing length of the conveying direction was shortened by 20% (printing aspect ratio (aspect ratio of characters) of 0.8).

Such uncomfortable feelings may be reduced by, in addition to the geometrical illusion (Wundt Fick illusion) in which the vertical line is recognized longer than the horizontal line, Mliller-Lyer illusion in which heat-sensitive paper bearing characters printed by the thermal printer P1 is provided in a slightly rolled (curved) state to the user, and the user sees the characters printed on the rolled heat-sensitive paper. Thus, when, similar print examples are printed on slightly rolled paper to conduct a similar questionnaire survey, results of the questionnaire survey are better than those of the above questionnaire survey (in other words, the number of those who have no uncomfortable feelings is larger than that of the above questionnaire results even when the printing length of the conveying direction is shortened by 20%). In other words, the questionnaire survey has proved that the printing length of the conveying direction may be shortened by 20% without any uncomfortable feelings on the part of the user.

Next, referring to FIGS. 4 to 6B, a thermal printer according to a second embodiment of the present invention is described.

Figure 4:
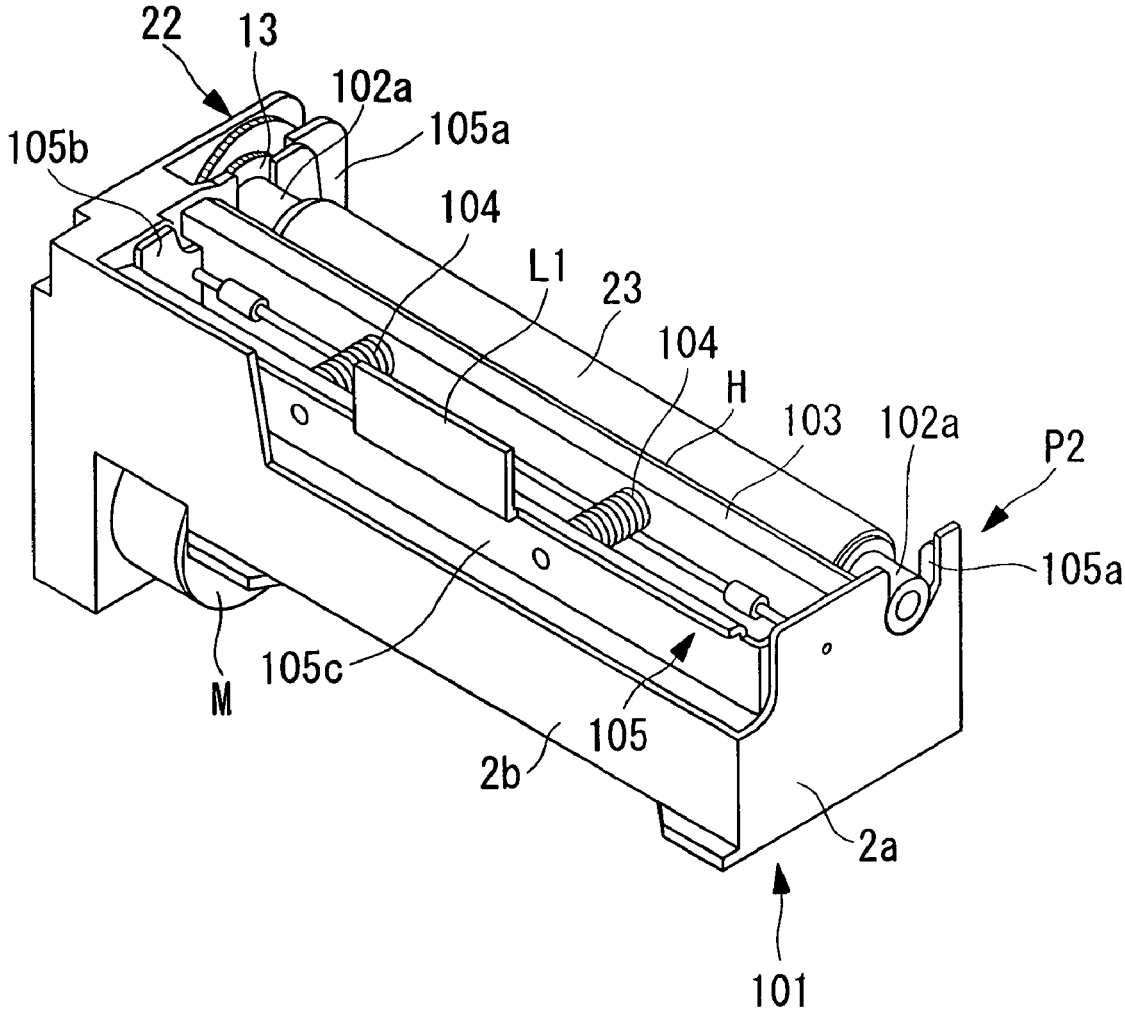
FIG. 4 is a perspective diagram illustrating a thermal printer according to a second embodiment of the present invention.
Figure 5:
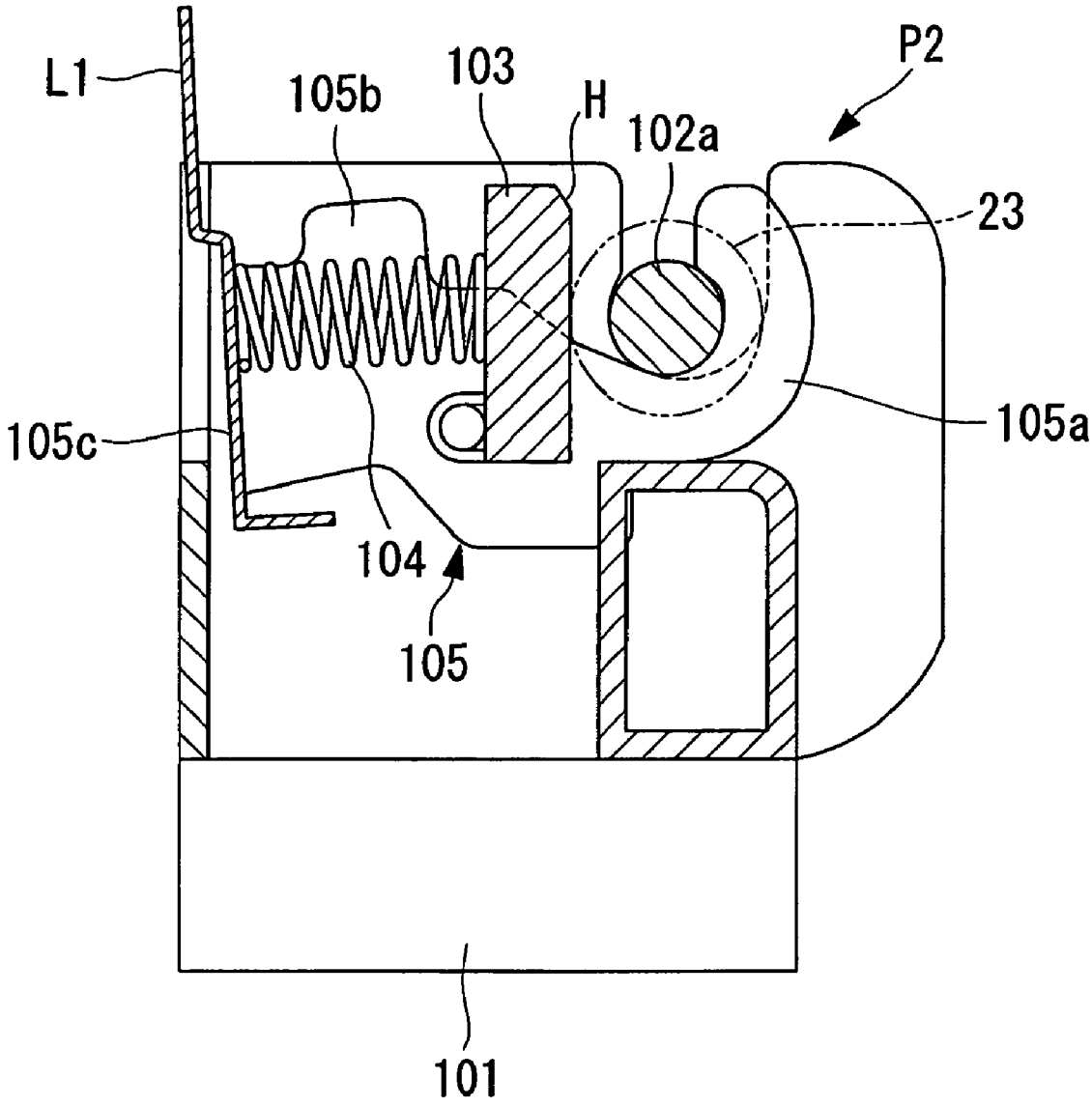
FIG. 5 is a sectional diagram of FIG. 4.
Figure 6A:
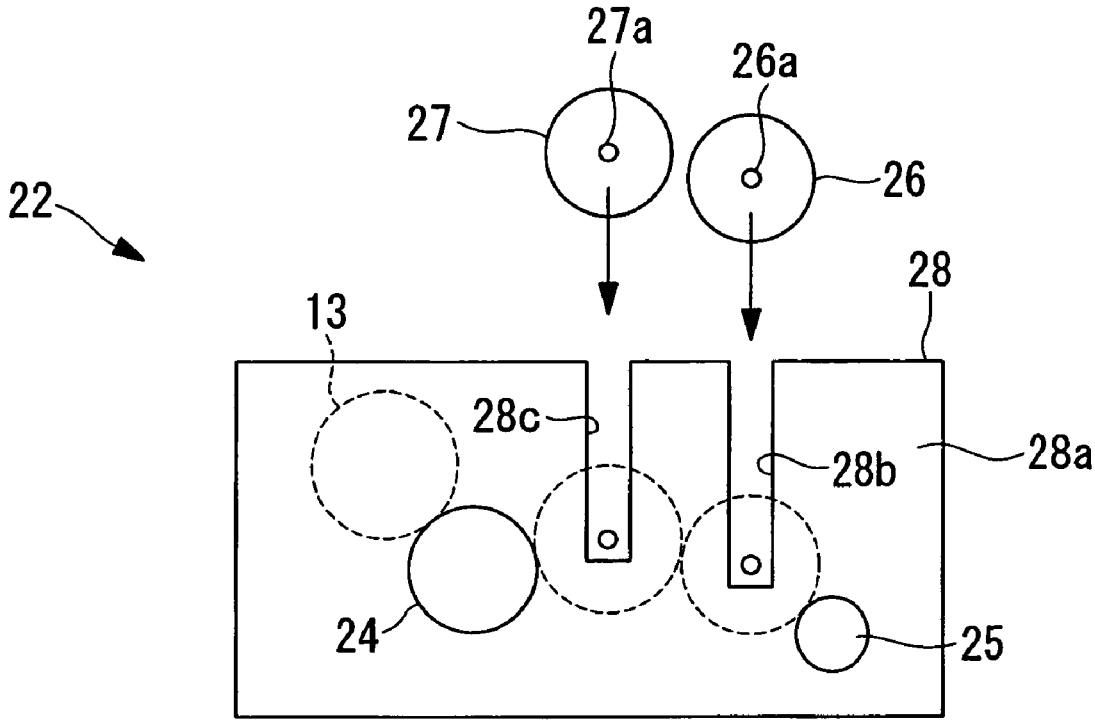
FIGS. 6A and 6B illustrate main portions of the thermal printer of FIG. 4, i.e.
Figure 6B:
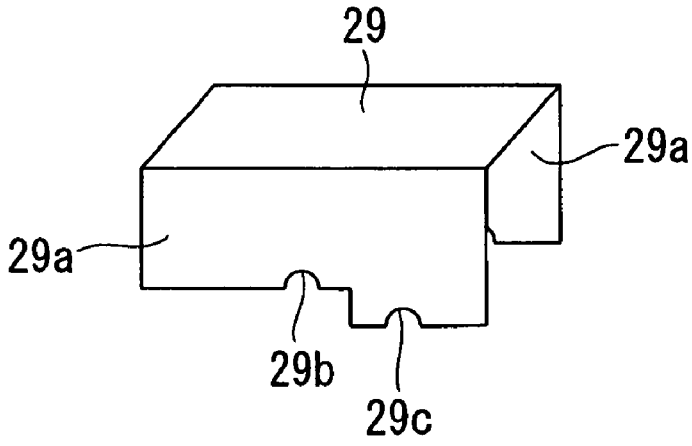

FIG. 4 is a perspective diagram illustrating the thermal printer of this embodiment. FIG. 5 is a sectional diagram of FIG. 4. FIGS. 6A and 6B illustrate main portions of the thermal printer; FIG. 6A is a schematic diagram illustrating a configuration of a rotation transmission mechanism and FIG. 6B is a perspective diagram of a cover constituting the rotation transmission mechanism.

The thermal printer P2 of this embodiment is different from that of the first embodiment of the present invention in that a rotation transmission mechanism 22 and a platen roller 23 are disposed in place of the rotation transmission mechanism G and the platen roller 102, and a feeding amount (more specifically, an outer diameter of the platen roller 23 or a gear ratio of a gear constituting the rotation transmission mechanism 22) of heat-sensitive paper is set so as to set an aspect ratio of characters printed on the heat-sensitive paper passed between a printing surface (not shown) of a thermal head H and the platen roller 23 to 1:1. Other components are similar to those of the first embodiment described above, and thus description thereof is omitted.

As illustrated in FIG. 6A, the rotation transmission mechanism 22 includes a first gear 24 engaged with a driven gear 13 fixed to one end of the platen roller 23, a second gear 26 engaged with a motor gear 25 fixed to one end of a rotary shaft of a motor M, a third gear 27 disposed between the first and second gears 24 and 25 to be engaged therewith, a casing 28 for housing the driven gear 13, the first gear 24, the motor gear 25, and the second and third gears 26 and 27, and a cover (upper lid) 29 disposed over the casing 28.

In both side walls 28*a* of the casing 28, notches 28*b* and 28*c* for receiving rotary shafts 26*a* and 27*a* of the second and third gears 26 and 27 to rotatably support them are disposed in a height direction (up-and-down direction of FIG. 6A) of the side walls 28*a*. Thus, the second and third gears 26 and 27 are attachable to and detachable from the casing 28.

On the other hand, the first gear 24 is only rotatably attached (supported by a bearing) to the casing 28, not detachable from the casing 28.

As illustrated in FIG. 6B, the cover (upper lid) 29 is a plate-shaped member having a U-shaped section to be detachable from the casing 28. In lower ends of both side walls 29*a* of the cover 29, notches 29*b* and 29*c* for supporting the rotary shafts 26*a* and 27*a* of the second and third gears 26 and 27 by bearings are disposed. Thus, the second and third gears 26 and 27 may be stably rotated.

According to the thermal printer P2 of this embodiment, the second and third gears 26 and 27 constituting the rotation transmission mechanism 22 may be detached from the casing 28. Thus, the second and third gears 26 and 27 may be easily changed for other gears (not shown) of different gear ratios. In other words, by changing the second and third gears 26 and 27 for other gears of different gear ratios, an aspect ratio of characters printed on the heat-sensitive paper may be changed from, for example, 1:1 to 0.9:1 or 0.8:1 by changing the feeding amount of the heat-sensitive paper passed between the printing surface (not shown) of the thermal head H and the platen roller 23. By changing the other gears of different gear ratios for the second and third gears 26 and 27, an aspect ratio of characters printed on the heat-sensitive paper may be changed from, for example, 0.8:1 or 0.9:1 to 1:1.

Thus, the user of the thermal printer P2 can easily change the aspect ratio of the characters printed on the heat-sensitive paper only by changing the second and third gears 26 and 27 for others. As a result, convenience may be improved for the user.

The maker that manufactures and sells the thermal printer P2 can easily change the aspect ratio of the characters printed on the heat-sensitive paper to meet the needs of the user of the thermal printer P2, realizing differentiation from products of other companies.

Figure 7A:
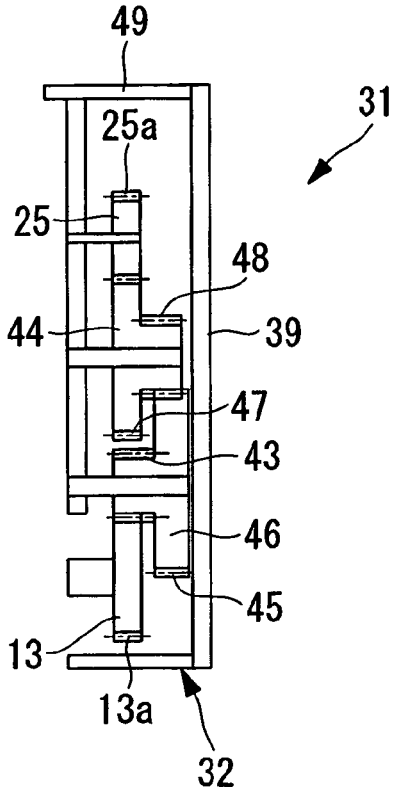
FIGS. 7A and 7B illustrate main portions of a thermal printer according to a third embodiment of the present invention, i.e.
Figure 7B:
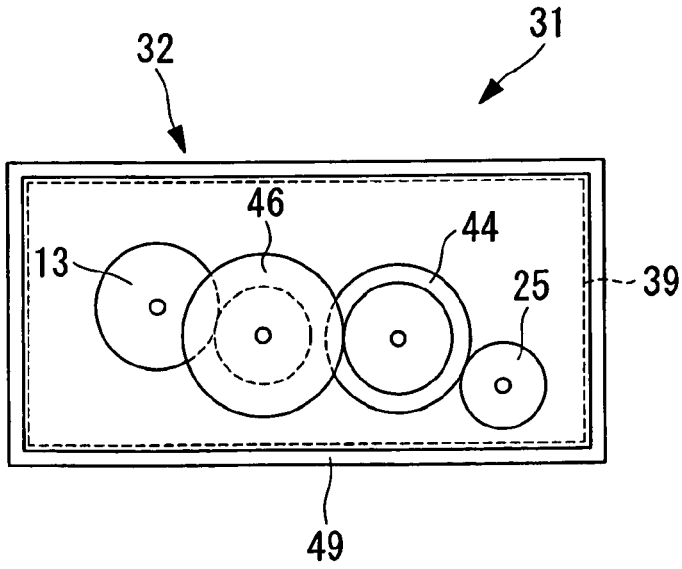

Referring to FIGS. 7A and 7B, a thermal printer according to a third embodiment of the present invention is described below.

FIGS. 7A and 7B are diagrams illustrating main portions of the thermal printer of this embodiment: FIG. 7A is a sectional diagram of a rotation transmission mechanism; and FIG. 7B is a schematic configuration diagram illustrating a removed state of a cover.

A thermal printer 31 of this embodiment is different from that of the above-mentioned second embodiment in that a rotation transmission mechanism 32 is disposed in place of the rotation transmission mechanism 22. Other components are similar to those of the second embodiment, and thus description thereof is omitted.

As illustrated in FIGS. 7A and 7B, the rotation transmission mechanism 32 includes a first gear 46 equipped with a tooth surface engaged with a tooth surface 13*a* of a driven gear 13 fixed to one end of a platen roller 23 and a tooth surface 45 engaged with a second gear 44 described below, the second gear 44 equipped with a tooth surface 47 engaged with a tooth surface 25*a* of a motor gear 25 fixed to one end of a rotary shaft of a motor M and a tooth surface engaged with the tooth surface 45 of the first gear 46, a casing for housing the driven gear 13, the first gear 46, the motor gear 25, and the second gear 44, and a cover (opening/closing member) detachably disposed over one side of the casing 49. The first and second gears 46 and 44 are each detachable from the casing 49.

The cover 39 is disposed in axial ends of the gears 44 and 46 and supports the gears 44 and 46 to prevent removal thereof when it is attached to cover the side of the casing 49. The cover 39 exposes the gears 44 and 46 to enable their easy replacement when it is removed from the side of the casing 49. After the replacement, the cover 39 only needs to be engaged with the casing 49 to be attached. This arrangement is advantageous when there is no space above the casing 49 but a space of the side may be used.

An operation effect of the thermal printer 31 of this embodiment is similar to that of the second embodiment of the present invention, and thus description thereof is omitted.

Figure 8:
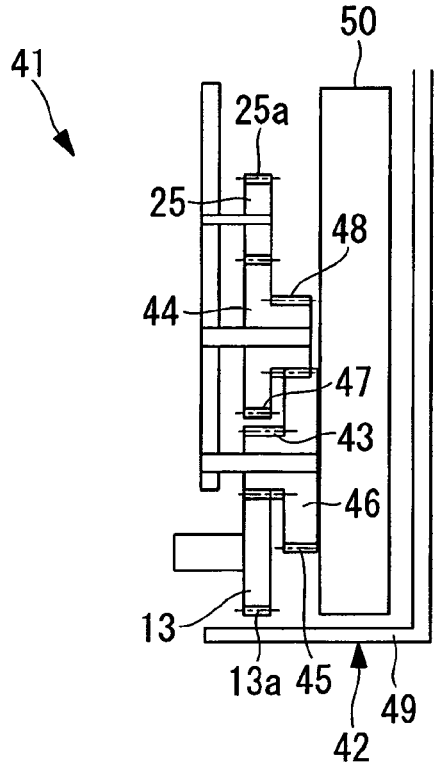
FIG. 8 is a sectional diagram illustrating a main portion of a thermal printer according to a fourth embodiment of the present invention.

Referring to FIG. 8, a thermal printer according to a fourth embodiment of the present invention is described below.

FIG. 8 is a sectional diagram illustrating a main portion of the thermal printer of this embodiment.

A thermal printer 41 of this embodiment is different from that of the above-mentioned second embodiment in that a rotation transmission mechanism 42 is disposed in place of the rotation transmission mechanism 22. Other components are similar to those of the above-mentioned second embodiment, and thus description thereof is omitted.

As illustrated in FIG. 8, the rotation transmission mechanism 42 includes a first gear 46 equipped with a tooth surface 43 engaged with a tooth surface 13*a* of a driven gear 13 fixed to one end of a platen roller 23 and a tooth surface 45 engaged with a second gear 44 described below, the second gear 44 equipped with a tooth surface 47 engaged with a tooth surface 25*a* of a motor gear 25 fixed to one end of a rotary shaft of a motor M and a tooth surface 48 engaged with the tooth surface 45 of the first gear 46, a casing 49 for housing the driven gear 13, the first gear 46, the motor gear 25, and the second gear 44, and a spacer 50 disposed between the casing 49 and the first and second gears 46 and 44. The first and second gears 46 and 44 and the spacer 50 are each detachable from the casing 49.

When replacing the gears 44 and 46, the spacer 50 is first removed from the casing 49 to secure a space for replacement, the gears 44 and 46 are removed from the shaft by using space, and then the gears 44 and 46 are removed to the upper side to be easily replaced. The spacer 50 may be made of a metal or a resin, and only needs to be inserted along the casing 49. Thus, replacement is easier as compared with the thermal printer according to the third embodiment illustrated in FIGS. 7A and 7B.

According to the thermal printer 41 of this embodiment, the first and second gears 46 and 44 constituting the rotation transmission mechanism 42 may be detached from the casing 49. Thus, the first and second gears 46 and 44 may be easily changed for other gears (not shown) of different gear ratios. In other words, by changing the first and second gears 46 and 44 for other gears of different gear ratios, an aspect ratio of characters printed on the heat-sensitive paper may be changed from, for example, 1:1 to 0.9:1 or 0.8:1 by changing the feeding amount of the heat-sensitive paper passed between the printing surface (not shown) of the thermal head H and the platen roller 23. By changing the other gears of different gear ratios for the first and second gears 46 and 44, an aspect ratio of characters printed on the heat-sensitive paper may be changed from, for example, 0.8:1 or 0.9:1 to 1:1.

Thus, the user of the thermal printer 41 can easily change the aspect ratio of the characters printed on the heat-sensitive paper only by changing the first and second gears 46 and 44 for others. As a result, convenience may be improved for the user.

The maker that manufactures and sells the thermal printer 41 can easily change the aspect ratio of the characters printed on the heat-sensitive paper to meet the needs of the user of the thermal printer 41, realizing differentiation from products of other companies.

Figure 9:
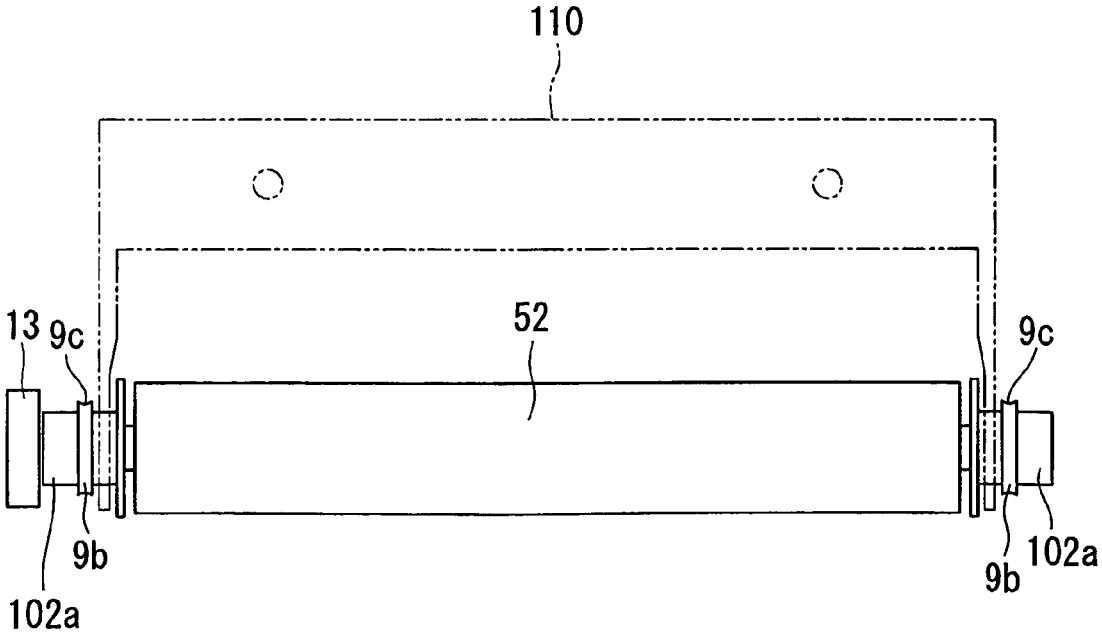
FIG. 9 is a plan diagram of a platen roller applicable to a thermal printer according to a fifth embodiment of the present invention.
Figure 10:
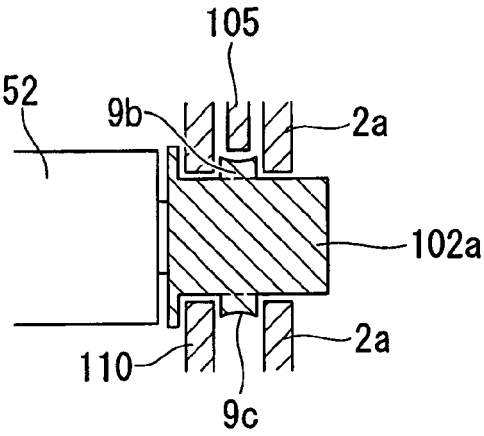
FIG. 10 is a main-portion sectional diagram illustrating an attached state of the platen roller of FIG. 9 to the thermal printer.

Referring to FIGS. 9 and 10, a thermal printer according to a fifth embodiment of the present invention is described below.

FIG. 9 is a plan diagram of a platen roller applicable to the thermal printer of this embodiment, and FIG. 10 is a main-portion sectional diagram illustrating an attached state of the platen roller to the thermal printer.

The thermal printer of this embodiment is different from that of the above-mentioned first embodiment in that a rotation transmission mechanism (not shown) and a platen roller 52 are disposed in place of the rotation transmission mechanism G and the platen roller 102, and a feeding amount (more specifically, an outer diameter of the platen roller 52 or a gear ratio of a gear constituting the rotation transmission mechanism) of heat-sensitive paper is set so that an aspect ratio of characters printed on the heat-sensitive paper passed between a printing surface (not shown) of a thermal head H and the platen roller 52 may be 1:1. Other components are similar to those of the above-mentioned first embodiment, and thus description thereof is omitted.

A reference numeral 110 in FIGS. 9 and 10 denotes, among devices for mounting the thermal printer, a platen holder for attaching the platen roller 52 to an opening/closing cover.

As in the case of the first embodiment of the present invention, the platen roller may be freely removed or attached by releasing a lock arm 105. Thus, the platen roller attached to the thermal printer of this embodiment is removed and, instead, or in place of a platen roller planned to be attached to the thermal printer of this embodiment, for example, the platen roller 52 as illustrated in FIGS. 9 and 10 is attached to the platen holder 110. As a result, an aspect ratio of characters printed on the heat-sensitive paper may be changed by changing the feeding amount of the heat-sensitive paper passed between the printing surface of the thermal head H and the platen roller.

The platen roller 52 illustrated in FIGS. 9 and 10 has an outer diameter of, for example, 0.8 times as large as that of the platen roller attached (or planned to be attached) to the thermal printer of this embodiment. Attaching (loading) this platen roller 52 enables changing of the aspect ratio of characters printed on the heat-sensitive paper from 1:1 to 0.8:1.

Replacing the platen roller 52 with the platen roller attached (or planned to be attached) to the thermal printer of this embodiment enables changing of the aspect ratio of characters printed on the heat-sensitive paper from 0.8:1 to 1:1.

Thus, a user of the thermal printer can easily change the aspect ratio of characters printed on the heat-sensitive paper only by changing the platen roller, thereby improving convenience for the user.

A maker that manufactures and sells the thermal printer can easily change the aspect ratio of characters printed on the heat-sensitive paper to meet needs of the user of the thermal printer, thereby achieving differentiation from products of other companies.

To deal with a situation in which a reduced outer diameter of the platen roller 52 causes a reduction in pressing force of the thermal head toward the platen roller, a diameter expansion unit (urging force (pressure-contact force) correction means) 9*b* like one illustrated in FIG. 10 is disposed at the center of the axial direction of the bearing 102*a*. The bearing support unit 105*a* illustrated in FIG. 5 is slightly rotated clockwise in FIG. 5, thereby rotating the arm 105*b* clockwise to press the coil spring 104. Thus, the pressing force of the thermal head H toward the platen roller may be increased.

More preferably, as illustrated in FIGS. 9 and 10, an end surface of the diameter expansion unit 9*b* brought into contact with the lock arm 105 is curved into a circular arc shape toward a rotary axis of the platen roller 52. Thus, engagement with the lock arm 105 is improved, removal of the platen roller 52 from the lock arm 105 is made difficult, and the platen roller 52 may be stably rotated.

As described above, to deal with the situation in which the bearing 102*a* illustrated in FIGS. 9 and 10 has a shape having an outer diameter of a part abutting on a side face 2*a* of the main body frame 101 approximately equal to that of a part abutting on the platen holder 110 as illustrated, and the reduced outer diameter of the platen roller 52 reduces the pressing force of the thermal head toward the platen roller, the diameter expansion unit 9*b* disposed in the center presses the coil spring 104 via the lock arm 105 to increase the pressing force of the thermal head H toward the platen roller. However, such a diameter expansion unit is not limited to the shape illustrated in FIGS. 9 and 10. A bearing configured in the following manner can provide the same effect as that of the bearing 102*a*.

Figure 11:
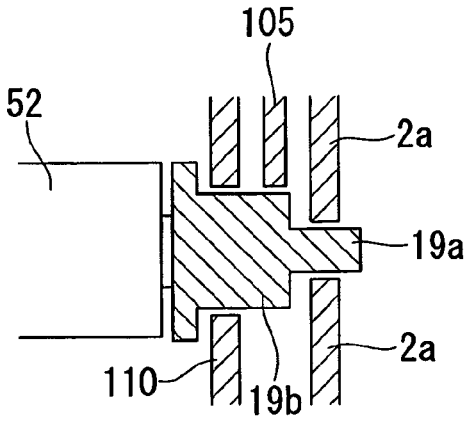
FIG. 11 is a diagram similar to that of FIG. 10 illustrating a thermal printer according to another embodiment of the present invention.

In other words, unlike the bearing illustrated in FIGS. 9 and 10, a platen roller including a bearing having a shape in which an outer diameter of a part of the bearing abutting on the side face 2*a* and an outer diameter of a part abutting on the lock arm 105 are smaller than that of a part abutting on the platen holder 110 may be employed (applied). If employing (applying) such a platen roller reduces the outer diameter of the platen roller 52, thereby reducing the pressing force of the thermal head toward the platen roller, a diameter expansion unit 19*b* of FIG. 11 in which an outer diameter of a part abutting on the lock arm 105 is increased to the size of that of a part abutting on the platen holder 110 or a diameter expansion unit 20*b* of FIG. 12 in which an outer diameter of a part abutting on the lock arm 105 is set to be smaller than that of a part abutting on the platen roller 110, and is increased to the size larger than that of a part abutting on the side face 2*a* is disposed in the part abutting on the lock arm 105. Thus, a bearing may be configured in which, with the diameter expansion unit 19*b* or 20*b*, the coil spring 104 is pressed via the lock arm 105 to increase the pressing force of the thermal head H toward the platen roller.

Figure 12:
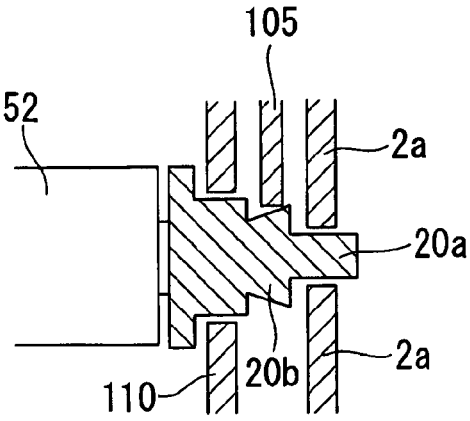
FIG. 12 is a diagram similar to that of FIG. 10 illustrating a thermal printer according to another embodiment of the present invention.

More preferably, as illustrated in FIG. 12, an end surface of the diameter expansion part 20*b* brought into contact with the lock arm 105 is formed into a V shape. Thus, engagement with the lock arm 105 is improved, removal of the platen roller 52 from the lock arm 105 is made difficult, and the platen roller 52 may be stably rotated.

Figure 13A:
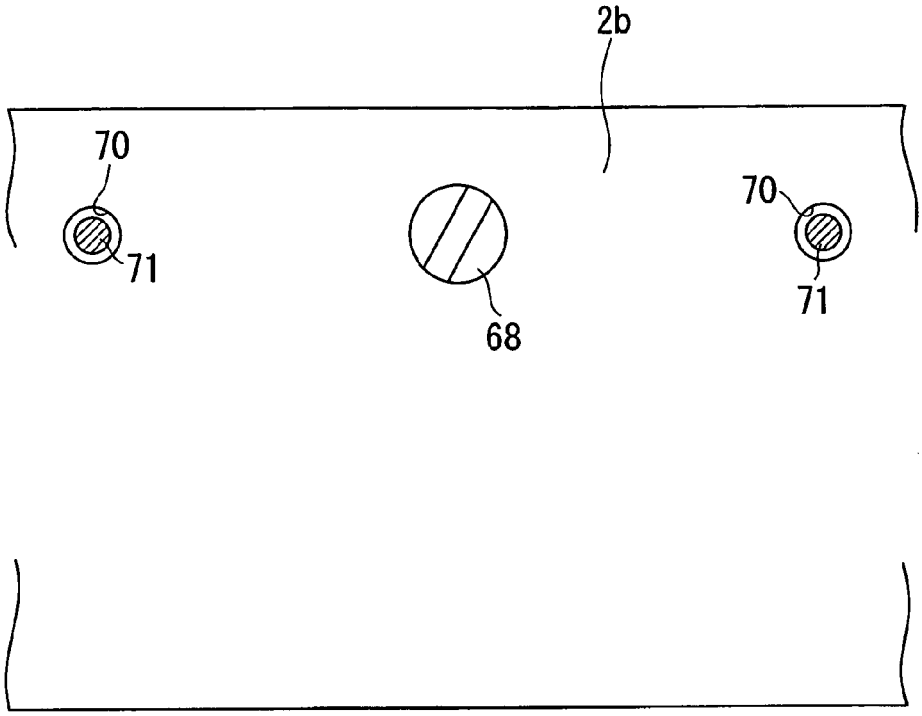
FIGS. 13A and 13B illustrate a thermal printer according to yet another embodiment of the present invention, i.e.
Figure 13B:
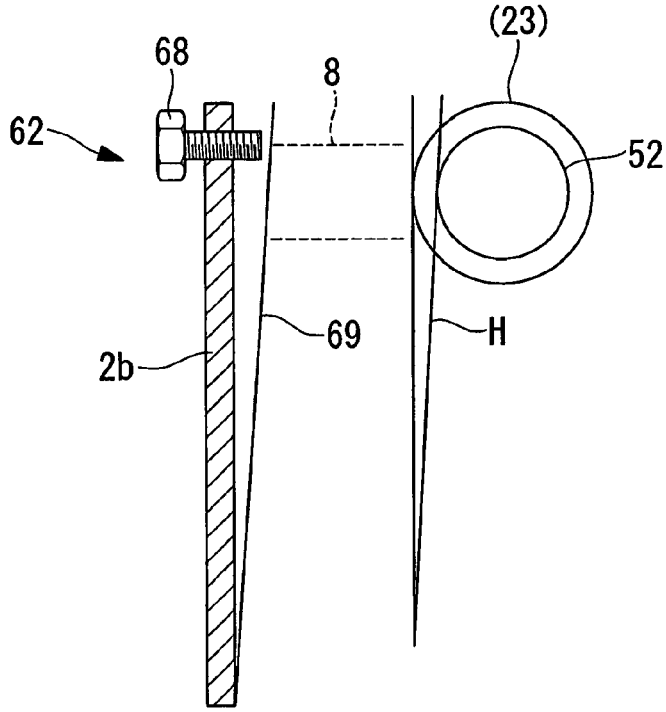

For a configuration to increase the pressing force of the thermal head H toward the platen roller, an urging force (pressure-contact force) correction means 62 illustrated in FIG. 13B may be disposed. The urging force (pressure-contact force) correction means 62 includes an auxiliary plate 69 disposed to move between a back connection plate 2*b* of the main body frame 101 and the thermal head H, and an adjust screw (adjusting member) 68 engaged with a female screw formed in the back connection plate 2*b* of the main body frame 101. The adjust screw 68 is screwed up or down with respect to the back connection plate 2*b* to swing (move) the auxiliary plate 69. An elastic deformation amount of a spring 8 is adjusted via the auxiliary plate 69 to change a pressure-contact force of the thermal head H to the platen roller 52.

Reference numeral 70 in FIG. 13A denotes a guide hole for guiding a convex portion 71 protruded from a back 69*a* of the auxiliary plate 69 to the back connection plate 2*b*.

The adjusting member is not limited to the adjust screw 68 of FIGS. 13A and 13B engaged with the female screw. The adjusting member only has to be structured such that the elastic deformation amount of the spring 8 via the auxiliary plate 69 is adjusted to change the pressure-contact force of the thermal head H to the platen roller 52. For example, such a structure may be employed in which, by using an adjusting member including a cam and a lever for rotating the cam in place of the adjusting member including the female screw and the adjust screw 68, and pressure is applied by rotating the cam to swing or move the auxiliary plate 69, thereby adjusting the elastic deformation amount of the spring 8. Not limited to an adjusting member for continuously changing a moving amount of the auxiliary plate 69 as in the case of the adjusting member including the female screw and the adjust screw 68, for example, such a structure may be employed in which one or more spacers (adjusting members) having predetermined thicknesses are inserted between the back connection plate 2*b* of the main body frame 101 and the auxiliary plate 69 to adjust the elastic deformation amount of the spring 8 in stages.

In the thermal printer of a type in which the coil spring 104 is supported on the main body frame 101 in a fixed manner (type in which the arm 105*b* of the lock arm 105 does not swing), more preferably, an urging force (pressure-contact force) correction means 62 is disposed, which increases (enhances) an urging force for urging the thermal head H toward the platen roller 52 to increase (enhances) a pressure-contact force (pressing force) of the thermal head H to the platen roller 52. Thus, even when the platen roller 52 is attached to the thermal printer, an original state may be maintained without reducing the pressure-contact force of the thermal head H to the platen roller 52 (in other words, pressure-contact force equal to that when the platen roller attached (or planned to be attached) to the thermal printer first is attached may be obtained).

Figure 14:
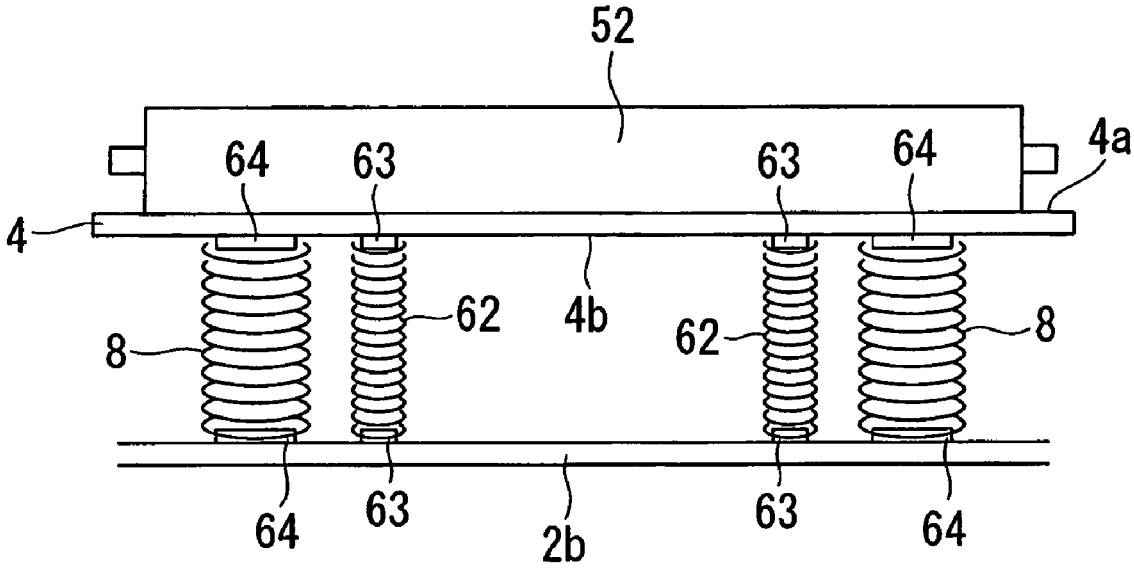
FIG. 14 is a main-portion schematic configuration diagram illustrating a thermal printer according to yet another embodiment of the present invention.

The urging force (pressure-contact force) correction means 62 illustrated in FIG. 14 includes a plurality of (e.g., 2) auxiliary springs disposed between the back connection plate 2*b* of the main body frame 101 and the back (surface opposed to the printing surface 4*a*) of the head support 4 for supporting the thermal head H. Both ends of each auxiliary spring are supported by projections 63 respectively formed on the back connection plate 2*b* and the back 4*b*.

Reference numeral 64 in FIG. 14 denotes a projection for supporting both ends of a second spring 8.

As illustrated, forming the projections 63 and 64 having predetermined sizes and positions beforehand enables the user to easily add supplied coil springs to predetermined positions without fail. Those projections are not disposed simply for positioning the coil springs, but set in positions obtained as design values by the maker so that a pressure-contact force may be uniform in view of the second spring. Thus, even when a platen diameter is changed, the user can easily set a coil spring supplied from the maker in an optimal position for maintaining printing quality. A structure in which both ends of the coil spring are supported by concaves such as grooves in place of the projections of FIG. 14, or a structure in which one end of the coil spring is supported by a projection while the other end is supported by a concave may be employed.

Figure 15:
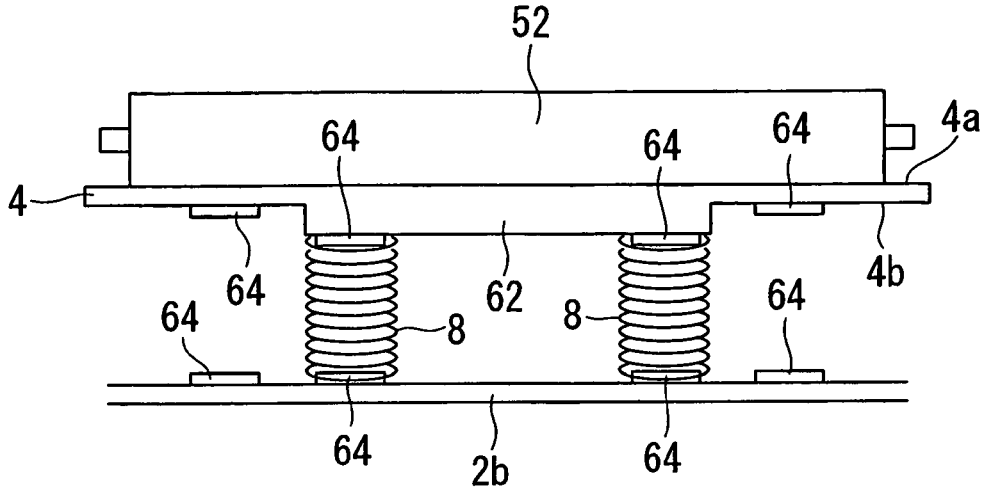
FIG. 15 is a main-portion schematic configuration diagram illustrating a thermal printer according to still yet another embodiment of the present invention.

An urging force (pressure-contact force) correction means 62 illustrated in FIG. 15 includes a step disposed to protrude from the back 4*b* of the head support 4 to the back connection plate 2*b* of the main body frame 101. Projections 64 are formed on the front surface of the step, and projections 64 are formed in the back connection plate 2*b* of the main body frame 101 opposed to the projections 64.

In this case, use of the same coil spring disposed in a trough enables a change to an illustrated position. A plurality of coil springs do not have to be prepared unlike the case of FIG. 14, and replacing convenience is extremely high. Though not shown, for example, disposing a plurality of projections 64 of the trough in a paper depth direction realizes a structure which enables selection of installing positions. By selecting an installing position, an urging force may be finely adjusted by the same coil spring. The head support 4 is generally a metal plate, and may be formed by press working as illustrated, and thus its manufacturing is relatively easy.

Figure 16:
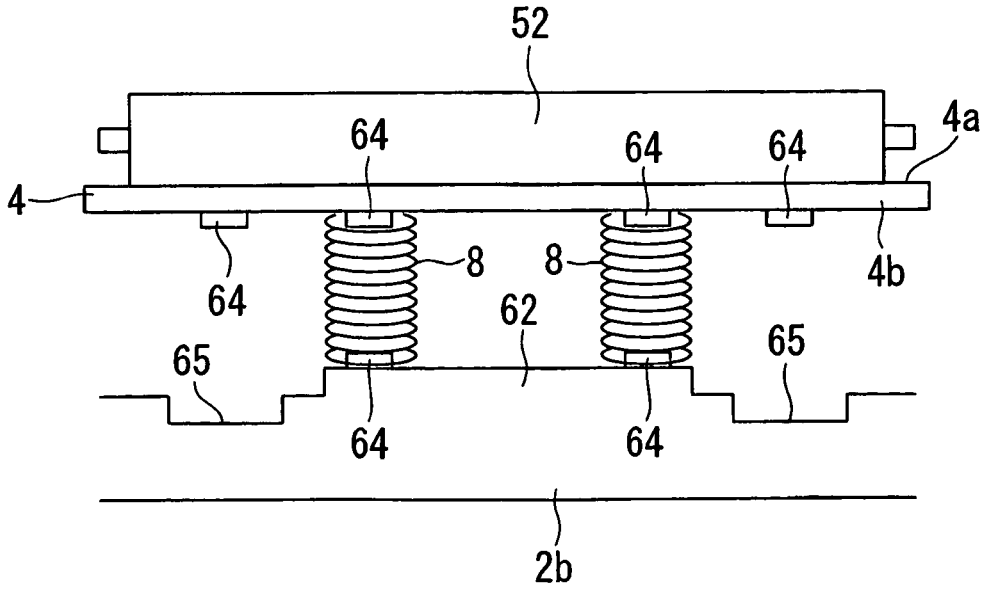
FIG. 16 is a main-portion schematic configuration diagram illustrating a thermal printer according to still yet another embodiment of the present invention.

An urging force (pressure-contact force) correction means 62 illustrated in FIG. 16 includes a step disposed to protrude from the back connection plate 2*b* of the main body frame 101 to the back 4*b* of the head support 4. Projections 64 are formed on the front surface of the step, and projections 64 are formed in the back 4*b* of the head support 4 opposed to the projections.

Reference numeral 65 in FIG. 16 denotes a concave (recess) formed in place of the projection 64 to receive and support one end of the second coil spring 8.

As in the case of FIG. 15, in FIG. 16, the back connection plate 2*b* may be made of plastic, and thus its manufacturing is easier than that in FIG. 15. A plurality of concaves 65 may be formed.

The present invention is not limited to the above-mentioned embodiments. Various modifications, changes and combinations may be made appropriately without departing from technical teachings of the present invention.

What is claimed is:

1. A thermal printer comprising:

a main body frame;

a thermal head attached to the main body frame to swing relative to the main body frame;

a platen roller disposed to face a printing surface of the thermal head;

a motor for rotating and driving the platen roller; and a rotation transmission mechanism for transmitting a rotation force of the motor to the platen roller, the thermal printer being configured to activate the thermal head while conveying heat-sensitive paper held between the thermal head and the platen roller to perform printing on the heat-sensitive paper, wherein a feeding amount of the heat-sensitive paper may be set so that an aspect ratio of characters printed on the heat-sensitive paper is within a range of 0.95:1 to 0.8:1 by changing at least one gear constituting the rotation transmission mechanism for another.

2. A thermal printer according to claim 1; wherein the rotation transmission mechanism includes a casing having a groove for detachably moving the gear, and a cover for holding a shaft of the gear between the cover and the groove of the casing.

3. A thermal printer according to claim 1; wherein the rotation transmission mechanism changes the gear by attaching/detaching an opening/closing member disposed at a shaft end of the gear.

4. A thermal printer according to claim 1; wherein the rotation transmission mechanism changes the gear by removing a detachable spacer disposed at a shaft end of the gear.

5. A thermal printer, comprising:

a main body frame;

a thermal head attached to the main body frame to swing relative to the main body frame;

a platen roller disposed to face a printing surface of the thermal head; and a motor for rotating and driving the platen roller, the thermal printer being configured to activate the thermal head while conveying heat-sensitive paper held between the thermal head and the platen roller to perform printing on the heat-sensitive paper, wherein a feeding amount of the heat-sensitive paper may be set so that an aspect ratio of characters printed on the heat-sensitive paper is within a range of 0.95:1 to 0.8:1 by changing the platen roller for another.

6. A thermal printer according to claim 5; further comprising urging force correction means for changing, by changing an urging force that urges the thermal head toward the platen roller, a press-contact force of the thermal head to the platen roller.

7. A thermal printer according to claim 6; further comprising:

a lock arm for rotatably supporting bearings disposed at both ends of the platen roller; and a spring for applying an urging force in a direction for pressing the thermal head to the platen roller supported by the lock arm, wherein the urging force correction means changes outer diameters of the bearings supported by the lock arm.

8. A thermal printer according to claim 6; further comprising:

an auxiliary plate disposed between the main body frame and the thermal head to move; and a spring disposed between the auxiliary plate and the thermal head to apply an urging force in a direction pressing the thermal head to the platen roller, wherein the urging farce correction means includes an adjusting member for adjusting an elastic deformation amount of the spring via the auxiliary plate.

9. A thermal printer according to claim 6; further comprising a head support for supporting the thermal head, wherein the urging force correction means is structured so that one of a plurality of projections and a plurality of concaves are disposed in opposing positions of the main body frame and the head support, and a platen-direction pressing force of the thermal head is changed by changing the number of coil springs disposed in positions of the one of the plurality of projections and the plurality of concaves.

10. A thermal printer according to claim 6; further comprising:

a head support for supporting the thermal head; and a spring for applying an urging force in a direction pressing the thermal head to the platen roller, wherein the urging force correction means is structured so that a platen-direction pressing force of the thermal head is changed by changing a position of the spring to a different position of a facing distance between the main body frame and the head support based on a step disposed in at least one of the main body frame and the head support.

* * * * *